US009472848B2

(12) United States Patent
Pajona et al.

(10) Patent No.: US 9,472,848 B2
(45) Date of Patent: Oct. 18, 2016

(54) MULTI-FEED LOOP ANTENNA

(71) Applicants: Olivier Pajona, Nice (FR); Laurent Desclos, San Diego, CA (US); Seng Thail Sron, Nice (FR)

(72) Inventors: Olivier Pajona, Nice (FR); Laurent Desclos, San Diego, CA (US); Seng Thail Sron, Nice (FR)

(73) Assignee: ETHERTRONICS, INC., San Diego, CA (US)

( * ) Notice: Subject to any disclaimer, the term of this patent is extended or adjusted under 35 U.S.C. 154(b) by 0 days.

(21) Appl. No.: 14/145,769

(22) Filed: Dec. 31, 2013

(65) Prior Publication Data

US 2015/0048991 A1 Feb. 19, 2015

Related U.S. Application Data

(63) Continuation-in-part of application No. 13/868,093, filed on Apr. 22, 2013.

(60) Provisional application No. 61/636,553, filed on Apr. 20, 2012.

(51) Int. Cl.

| | |
|---|---|
| ***H01Q 1/50*** | (2006.01) |
| ***H01Q 7/00*** | (2006.01) |
| ***H01Q 1/24*** | (2006.01) |
| ***H01Q 21/28*** | (2006.01) |
| ***H01Q 5/307*** | (2015.01) |

(52) U.S. Cl.

CPC ..... *H01Q 7/00* (2013.01); *H01Q 1/243* (2013.01); *H01Q 5/307* (2015.01); *H01Q 21/28* (2013.01)

(58) Field of Classification Search

CPC ..... H01Q 1/50; H01Q 7/00; H01Q 5/307; H01Q 21/28

See application file for complete search history.

(56) References Cited

U.S. PATENT DOCUMENTS 6,342,856 B1 * 1/2002 Nakano ..... H01Q 7/00 343/700 MS 6,771,223 B1 8/2004 Shoji

FOREIGN PATENT DOCUMENTS

JP 2007-288352 A * 11/2007 ..... H01Q 1/50

* cited by examiner

*Primary Examiner* — Hoang V Nguyen

(74) *Attorney, Agent, or Firm* — Coastal Patent Law Group, P.C.

(57) ABSTRACT

A multi-feed antenna in provided, including multiple feed elements associated with multiple frequency regions, respectively, and a folded loop element for radiating energy. Each of the multiple feed elements is capacitively coupled to the folded loop element.

8 Claims, 11 Drawing Sheets

MULTI-FEED LOOP ANTENNA

CROSS-REFERENCE TO RELATED APPLICATIONS

This application is a CIP of U.S. Ser. No. 13/868,093, filed Apr. 22, 2013, and titled "LOOP ANTENNA WITH SWITCHABLE FEEDING AND GROUNDING POINTS"; which claims benefit of priority with U.S. Provisional Ser. No. 61/636,553, filed Apr. 20, 2012, titled "LOOP ANTENNA WITH SWITCHABLE FEEDING AND GROUNDING POINTS"; the contents of each of which are hereby incorporated by reference

BACKGROUND

The amount of wireless services supported by modern mobile devices, such as MP3 players, cellular phones, smart phones, laptops, video gaming devices, tablets, etc., have increased significantly during the last decade. These wireless services include voice call, Global Positioning System (GPS) coupled with an interactive map for navigation, Internet browsing, video call, gaming, music downloading, etc., and require increasingly higher data rates so that new protocols or new versions of an existing protocol are frequently released. These services are generally not deployed on the same frequency band in all countries, and the antennas used for the wireless communication have to cover many and/or wide frequency bands to support a wide variety of services with optimum data rates. However, for design and cosmetic reasons, most of the antennas used for the wireless communication are embedded within the device, in a very limited space, which has a negative impact on the bandwidth, the number of frequency bands and the efficiency of the embedded antennas, thereby limiting the availability and/or performances of the wireless services.

To overcome these issues, several solutions have been proposed over the years to increase the number of frequency bands and the bandwidth of each band that are supported by an antenna system. Typical solutions rely on a broadband matching circuit or addition of a parasitic element in the antenna to widen its operation range. However, in general, there are theoretical limits regarding how much the bandwidth of an antenna can be widened while keeping good enough performances. Another solution to address the problems mentioned above is to use multiple antennas, each supporting a subset of the frequency bands. In such an antenna system, relatively simple matching circuits can be designed for each antenna to maximize the bandwidth of each element. This type of solution, in which multiple antennas are utilized, can address the bandwidth problem; however, the physical volume allocated to the antenna system becomes large and is divided among the individual antennas, and thus radiation efficiency of each element tends to deteriorate.

As explained above, the volume of data transmission is required to be larger with even faster speed as the wireless services increase and QOS is further demanded. This motivates to obtain communication channels with wider bandwidths and efficient use of fragmented spectrum. For this purpose, the "carrier aggregation" scheme has been devised, wherein two or more component carriers are aggregated to support wide bandwidths. According to Release 10 of LTE-Advanced, for example, the data throughput is expected to reach 1 Gbps. Carrier aggregation may achieve a 100 MHz bandwidth by combining different carriers. There are three carrier aggregation modes to date: intra-band contiguous allocation, intra-band non-contiguous allocation and inter-band allocation. The intra-band contiguous allocation contiguously aggregates components carriers, each having about a 1.4 MHz bandwidth up to about a 20 MHz bandwidth, in one band. The intra-band non-contiguous allocation non-contiguously aggregates component carriers in one band, thereby having gaps between some of the component carriers. Note, however, that this carrier aggregation is not supported by the Release 10 at present time. The inter-band allocation aggregates component carriers in different bands, resulting in a non-contiguous allocation with gaps. Thus, the carrier aggregation scheme is expected to allow for simultaneous transmit and receive, which poses new challenges in RF front-end circuit and antenna designs, modulations/demodulations and various other RF techniques.

DETAILED DESCRIPTION OF THE PREFERRED EMBODIMENTS

In view of the aforementioned problems associated with the needs for antenna systems that can support a wide bandwidth and multiple frequency bands, a new type of multi-feed antenna is provided according to the present invention. High efficiency with small volume allocation can be realized using the present multi-feed antenna, which is considered to be well suited for the Long Term Evolution (LTE) carrier aggregation scheme.

Figure 1:
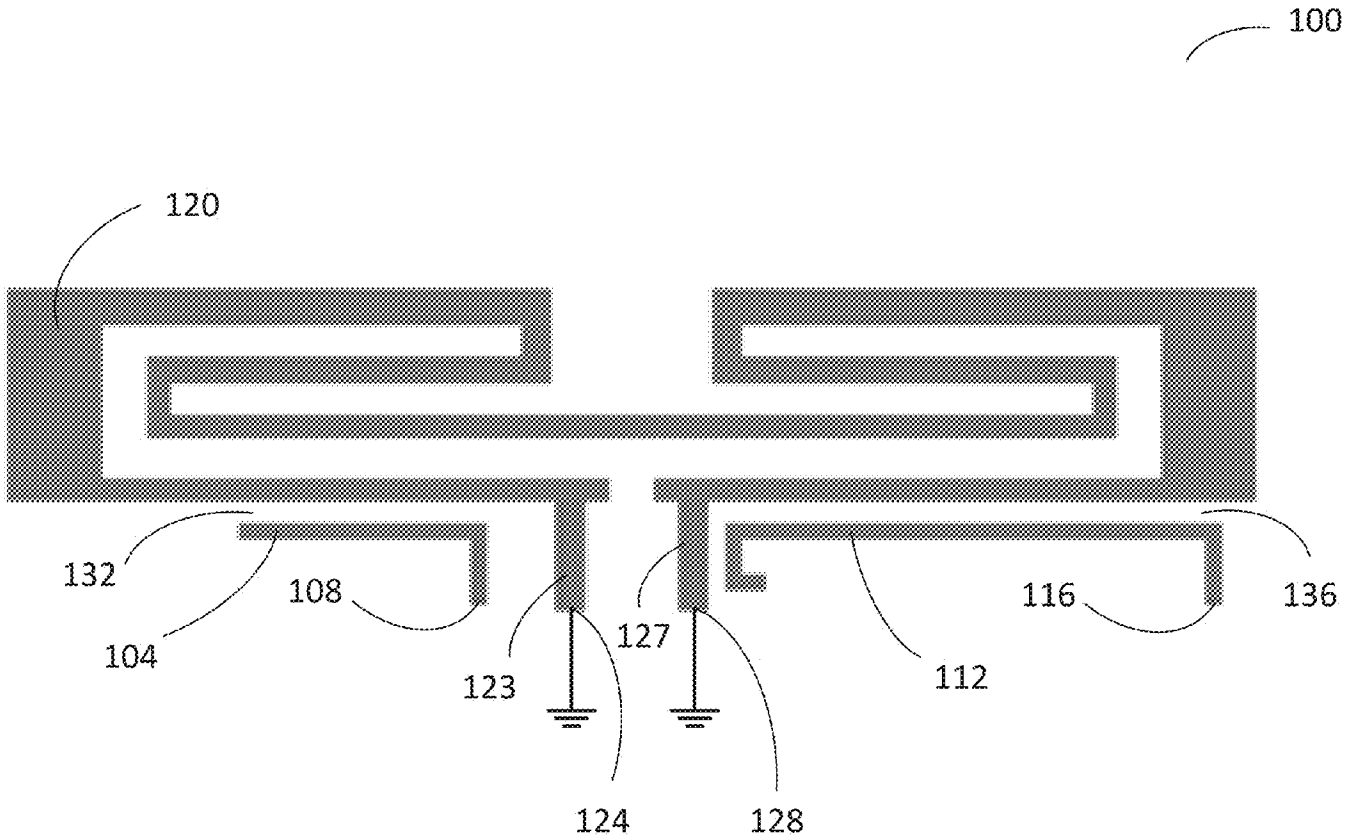
FIG. 1 illustrates an example of a dual-feed antenna according to an embodiment.

FIG. 1 illustrates an example of a dual-feed antenna 100 according to an embodiment. In this example, the dual-feed antenna 100 includes multiple conductive elements printed on a dielectric material, such as FR4, plastic, ceramic, etc.

This antenna is basically a loop antenna, which generally has a loop element. The dual-feed antenna 100 has a first feed element 104 having one end portion as a first feed point 108 coupled to an RF signal source and a second feed element 112 having one end portion as a second feed point 116 coupled to an RF signal source, and further includes a folded loop element 120. The folded loop element 120 can be configured to include a first grounding portion 123 having a first end portion 124 shorted to ground, and a second grounding portion 127 having a second end portion 128 shorted to ground. Alternatively, one of the first and second end portions 124 and 128 may be shorted to ground, while the other end portion is kept open. Yet alternatively, the grounding portions 123 and 127 may be merged into one without the gap in between to provide one end portion shorted to ground. The shape and dimensions of each segment and the number of bends of the folded loop element 120 between the first end portion 124 and the second end portion 128 can be changed depending on targeted resonances, bandwidths, and other performance metrics. The overall geometry does not have to be symmetric. A round corner may be used instead of a sharp corner at the bend of the folded loop 120. Wide patches or thin meander lines may be used for some segments of the folded loop element 120. The first feed element 104 is capacitively coupled through a first gap 132 to the folded loop element 120; and the second feed element 112 is capacitively coupled through a second gap 136 to the folded loop element 120. Thus, these two feed elements 104 and 112 are capacitively coupled commonly to one folded loop element 120. The shape and dimensions of each of the feed elements 104 and 112, as well as the width and length of each of the gaps 132 and 136, can be changed depending on targeted resonances, bandwidths, and other performance metrics. For example, the first feed element 104 may be configured to be shorter than the second feed element 112, so that high bands can be associated with the first feed element 104 and low bands can be associated with the second feed element 112.

Figure 2:
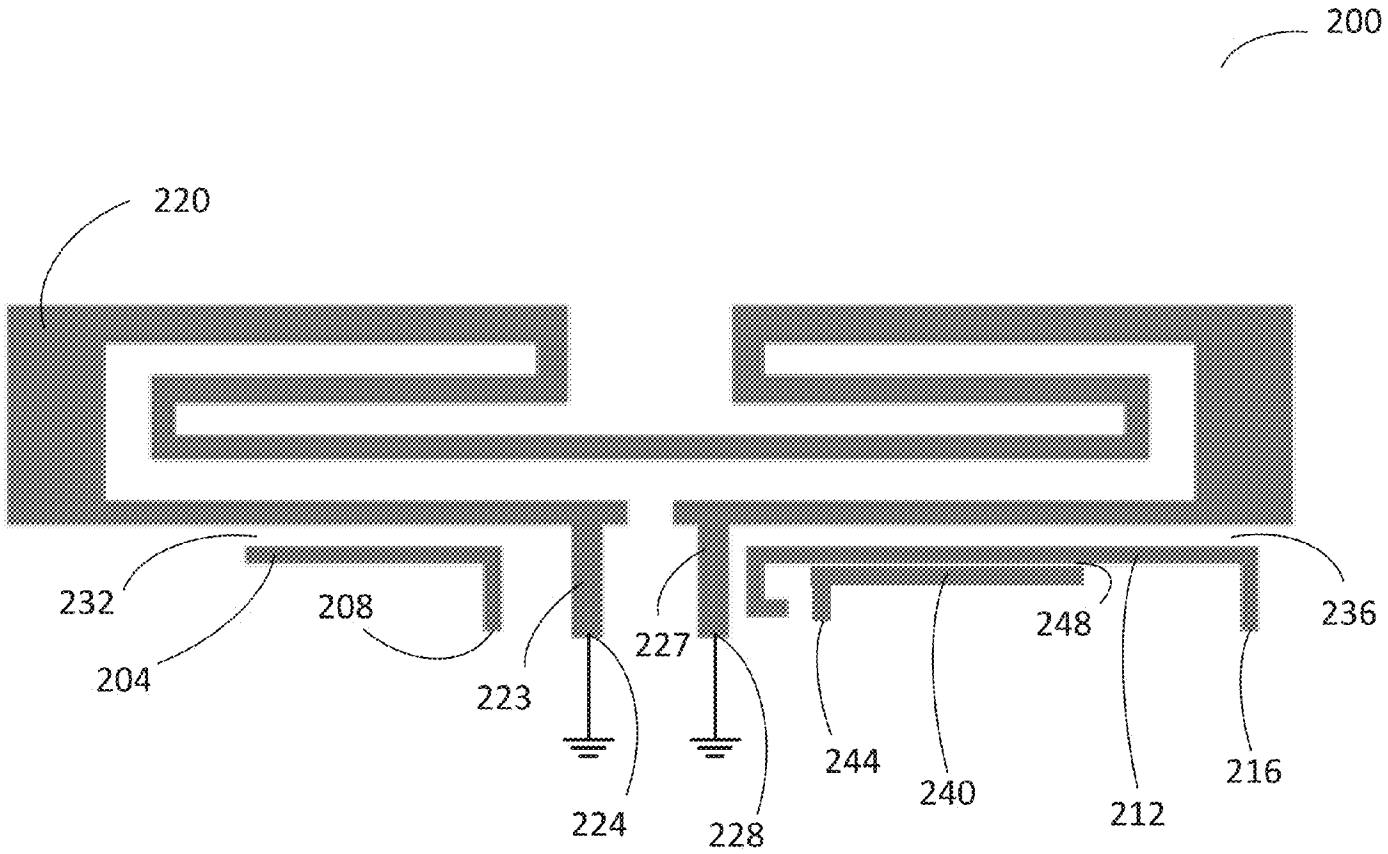
FIG. 2 illustrates an example of a triple-feed antenna according to an embodiment.

FIG. 2 illustrates an example of a triple-feed antenna 200 according to an embodiment. Similar to the dual-feed antenna 100 of FIG. 1, the triple-feed antenna 200 has a first feed element 204 having one end portion as a first feed point 208 coupled to an RF signal source and a second feed element 212 having one end portion as a second feed point 216 coupled to an RF signal source, and further includes a folded loop element 220. Additionally, the triple-feed antenna 200 has a third feed element 240 having one end portion as a third feed point 244 coupled to an RF signal source. The folded loop element 220 can be configured to include a first grounding portion 223 having a first end portion 224 shorted to ground, and a second grounding portion 227 having a second end portion 228 shorted to ground. Alternatively, one of the first and second end portions 224 and 228 may be shorted to ground, while the other end portion is kept open. Yet alternatively, the grounding portions 223 and 227 may be merged into one without the gap in between to provide one end portion shorted to ground. Similar to the dual-feed antenna 100 of FIG. 1, the first feed element 204 is capacitively coupled through a first gap 232 to the folded loop element 220; and the second feed element 212 is capacitively coupled through a second gap 236 to the folded loop element 220. The third feed element 240 is placed close to the second feed element 212 in this example, where the third feed element 240 is capacitively coupled through a third gap 248 to the second feed element 212, which is capacitively coupled through the second gap 236 to the folded loop element 220. Thus, each of these three feed elements 204, 212 and 240 is capacitively coupled, either directly or indirectly through an intermediary element, to one common folded loop element 220. The shape and dimensions of each of the feed elements 204, 212 and 240, as well as the width and length of each of the gaps 232, 236 and 248 can be changed depending on targeted resonances, bandwidths, and other performance metrics. For example, the first feed element 204 may be configured to be shorter than the second feed element 212, and the third feed element 240 may be configured to be even shorter than the first feed element 204. In this way, high bands can be associated with the third feed element 240, intermediate bands can be associated with the first feed element 204, and low bands can be associated with the second feed element 212.

Figure 2A:
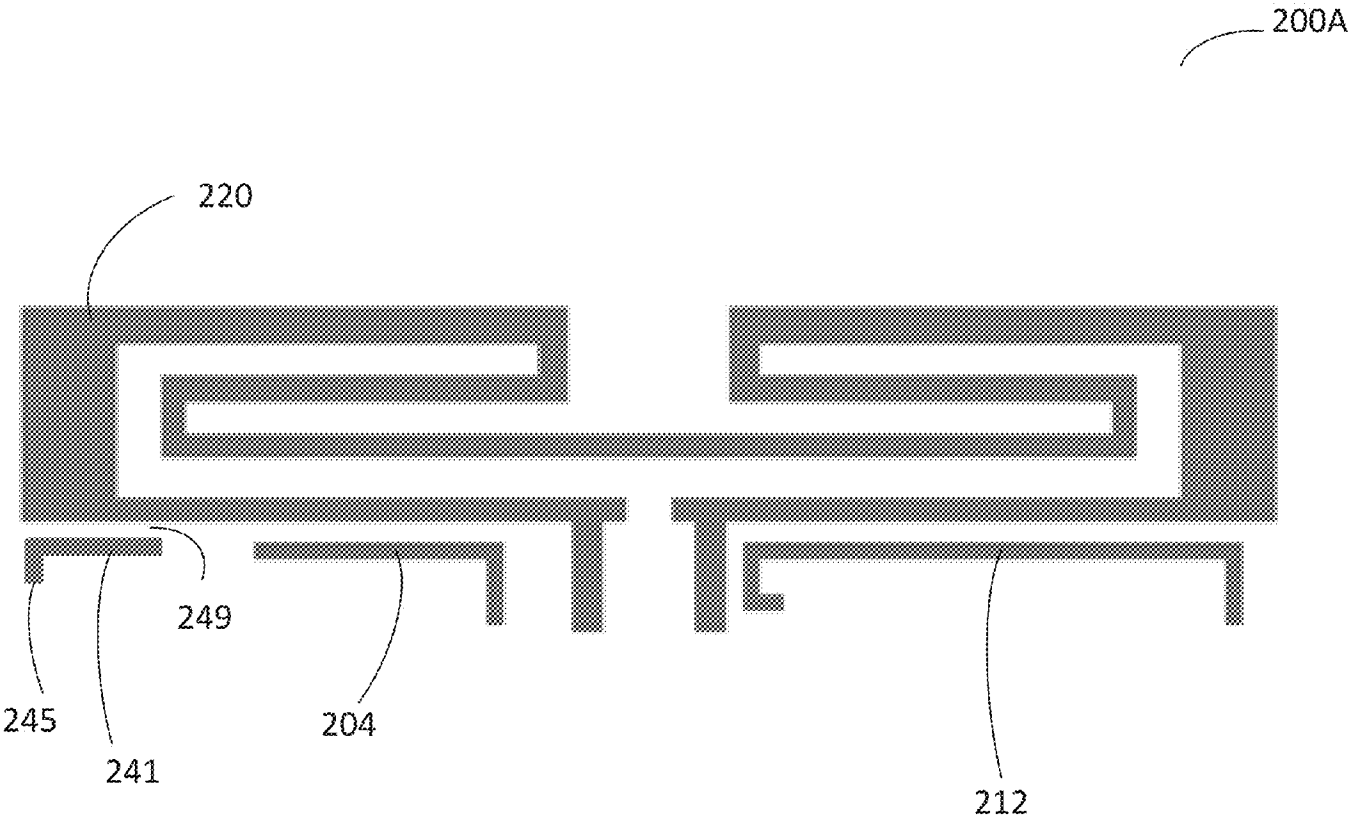
FIG. 2A illustrates another example of a triple-feed antenna 200A according to an embodiment, which is a variation of the triple-feed antenna of FIG. 2.

FIG. 2A illustrates another example of a triple-feed antenna 200A according to an embodiment, which is a variation of the triple-feed antenna 200 of FIG. 2. In the previous example of the triple-feed antenna 200, the third feed element 240 is placed close to the second feed element 212, where the third feed element 240 is capacitively coupled through the third gap 248 to the second feed element 212, which is capacitively coupled through the second gap 236 to the folded loop element 220. In the present example of the triple-feed antenna 200A, the third feed element 241 is placed close to the first feed element 204, and is capacitively coupled through a gap 249 to the folded loop element 220.

In general, the amount of radiation energy received by a loop antenna is, in part, determined by its area. Typically, each time the area of the loop is halved, the amount of energy which may be received is reduced by approximately 3 dB. Thus, the size-efficiency tradeoff is one of the major considerations for loop antenna designs. As exemplified in the dual-feed antenna 100 and the triple-feed antennas 200 and 200A, each of the multiple-feed antennas according to embodiments is configured to have two or more feed elements associated with respective frequency regions, wherein each of these feed elements is capacitively coupled, directly or indirectly through another element, to one common folded loop element, which is the main radiating part of the overall antenna system. Thus, size reduction can be achieved by using the present multi-feed antenna since the folded loop element is commonly shared by the multiple feed elements for different frequency regions. Some conventional dual feed antennas are configured by using a single feed antenna element combined with a diplexer to create the two feed points. However, this additional component typically brings ~0.3 dB losses in low band and ~0.6 dB losses in high band. In contrast, the multi-feed antenna according to the embodiment does not include a diplexer or a multipler, thereby preventing the losses typically incurred in a conventional dual- or a multi-feed antenna. Furthermore, the capacitive coupling incorporated in the present mullet-feed antenna may allow for a large bandwidth for each frequency region by properly designing the width and length of each gap. In this case, the capacitive coupling can be viewed as a wide-band impedance matching circuit for improving the bandwidth.

Figure 3:
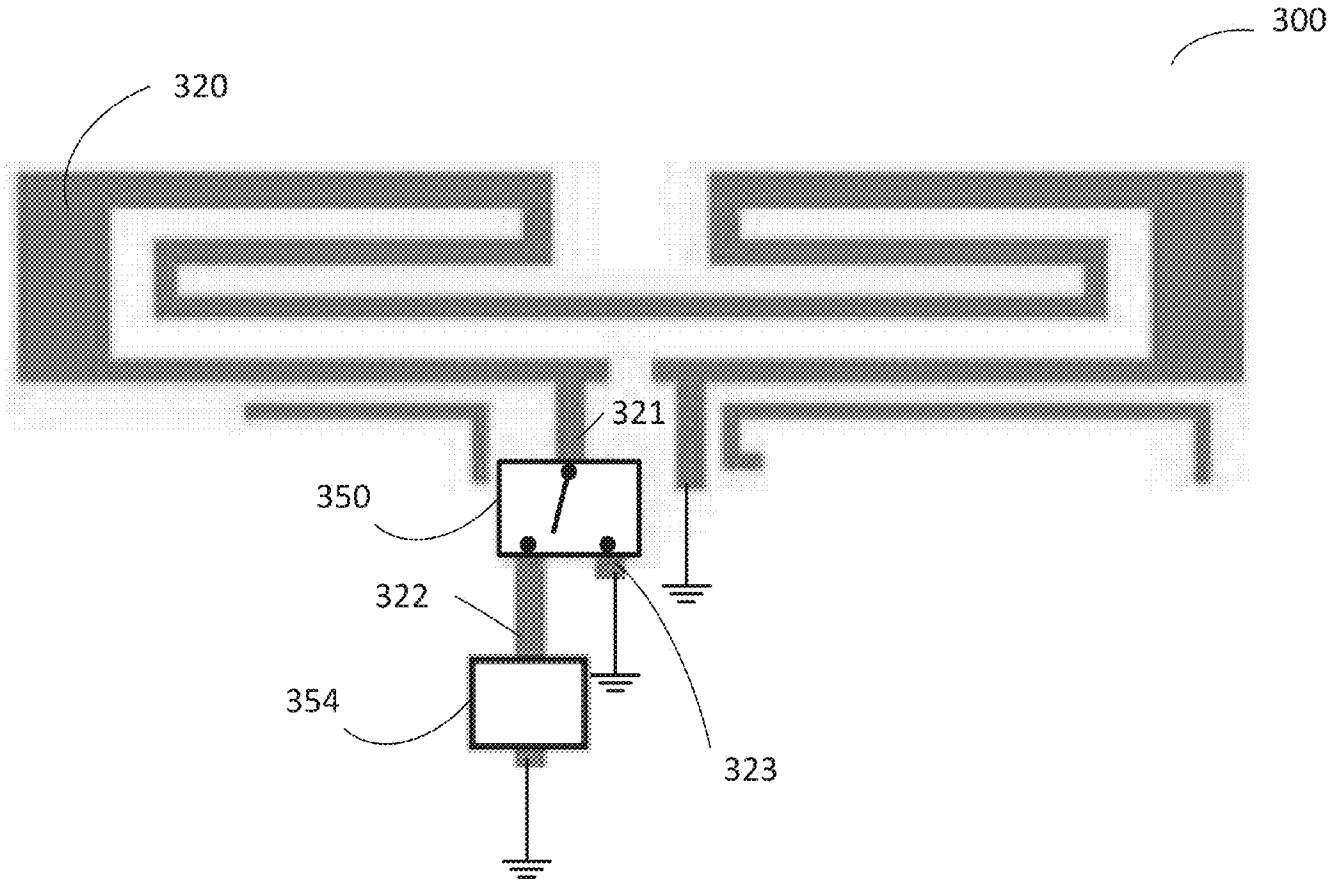
FIG. 3 illustrates another example of a dual-feed antenna according to an embodiment, where an active component and a matching circuit are included.

FIG. 3 illustrates another example of a dual-feed antenna 300 according to an embodiment, where an active component and a matching circuit are included. In this example, a grounding portion 321 of the folded loop element 320 is configured to have a first branch 322 and a second branch 323. A single pole double throw (SPDT) switch 350 is provided at the branching point and controlled to select one of the branches 322 and 323. In the present example, a matching circuit 354 is coupled to the branch 322, which is then shorted to ground, while the branch 323 is directly shorted to ground. The matching circuit 354 may be coupled to the branch in series or in shunt, and is configured to provide impedance loading to the folded loop element 320. The matching circuit 354 may include a lumped or distributed component, such as an inductor, a capacitor, a transmission line, etc., or a combination thereof to provide the impedance loading so that the antenna can be tuned to compensate for or counteract interference effects arising from environments or conditions, such as when a head or a hand is placed in the proximity of the device. The SPDT switch 350 is controlled to select either the branch 322 to provide the impedance loading afforded by the matching circuit 354 or the branch 323 to short the folded loop element 320 to ground when the impedance does not have to be adjusted.

In the above example, the number of branches splitting from the grounding portion 321 is two; however, three or more branches may be included, and a single pole multiple throw (SPMT) switch may be provided at the branching point. One or more of the branches may be coupled with one or more matching circuits, respectively, providing different impedance loadings for different environments or conditions. These impedance values may be predetermined and the designs of the matching circuits may be customized based on the expected environments or conditions that the device may encounter. Each of the two grounding portions of the folded loop element 320 may be configured to have a SPMT switch and a matching circuit. These switches may be configured based on an RF switch, a tunable capacitor, a MEMS switch, a PIN diode, a varactors diode, a tunable inductor, or other suitable switch technology.

Figure 4:
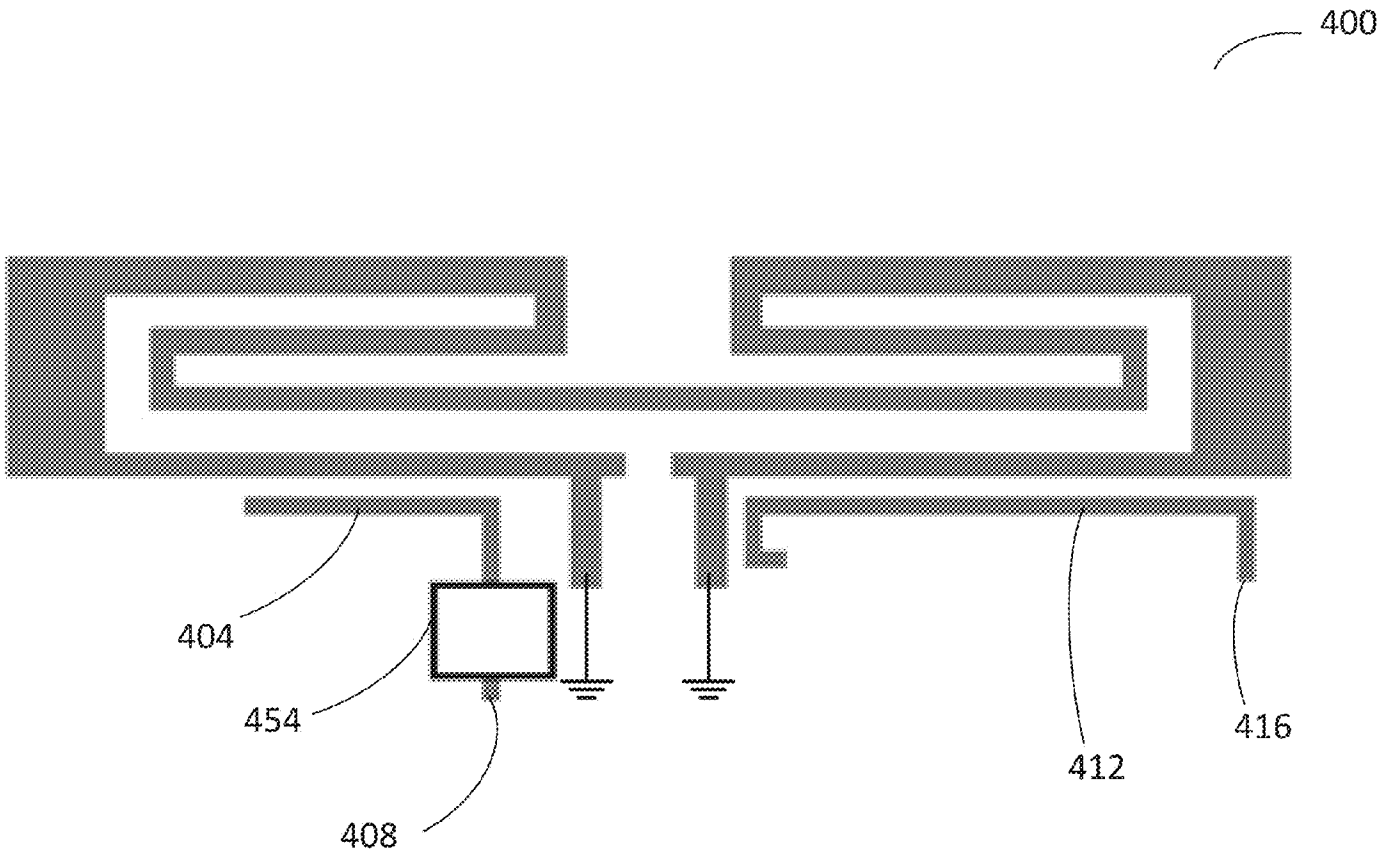
FIG. 4 illustrates another example of a dual-feed antenna according to an embodiment, where a matching circuit is included.

FIG. 4 illustrates another example of a dual-feed antenna 400 according to an embodiment, where a matching circuit is included. In this example, a matching circuit 454 is coupled to a first feed element 404 having a feed point 408 coupled to an RF signal source. The matching circuit 454 may be coupled in series or in shunt with the first feed element 404, and is configured to provide impedance loading to the first feed element 404. The matching circuit 454 may include a lumped or distributed component, such as an inductor, a capacitor, a transmission line, etc., or a combination thereof to provide the impedance loading so that the antenna can be tuned to compensate for or counteract interference effects arising from environments or conditions, such as when a head or a hand is placed in the proximity of the device.

In the above example of FIG. 4, the matching component 454 is coupled to the first feed element 404. Alternatively or additionally, a matching component may be coupled to the second feed element 412. Similarly, in the multi-feed antenna according to the embodiment having multiple feed elements, one or more matching components may be coupled to one or more feed elements, respectively, to provide different impedance loadings for different environments or conditions.

Figure 5:
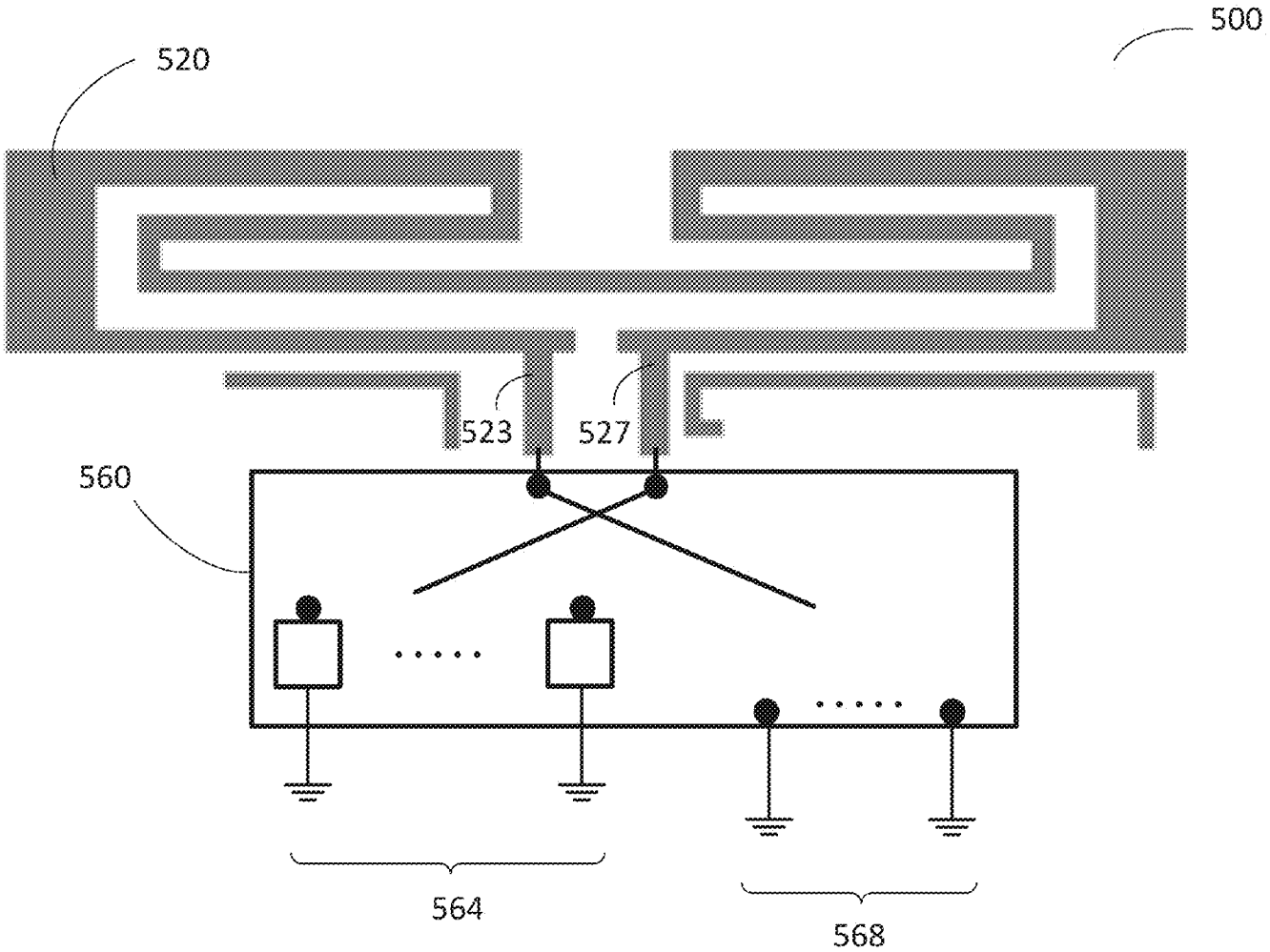
FIG. 5 illustrates another example of a dual-feed antenna according to an embodiment, where a swapping circuit is included.

FIG. 5 illustrates another example of a dual-feed antenna 500 according to an embodiment, where a swapping circuit 560 is included. In this example, the swapping circuit 560 is coupled to the two grounding portions 523 and 527 of the folded loop element 520. The swapping circuit 560 is configured to include one or more matching circuits 564 and one or more ground terminals 568. The swapping circuit is controlled by a controller to connect the grounding portion 523 and one selected from the group consisting of the one or more matching circuits 564 and the one or more ground terminals 568, and to connect the grounding portion 527 and one selected from the group consisting of the one or more matching circuits 564 and the one or more ground terminals 568. The swapping circuit 560 can thus be viewed as a double pole multiple throw (DPMT) switch, where one or more of the multiple throw parts are associated with the one or more matching circuits 564, respectively, and the others of the multiple throw parts are associated with the one or more ground terminals 568.

Figure 5A:
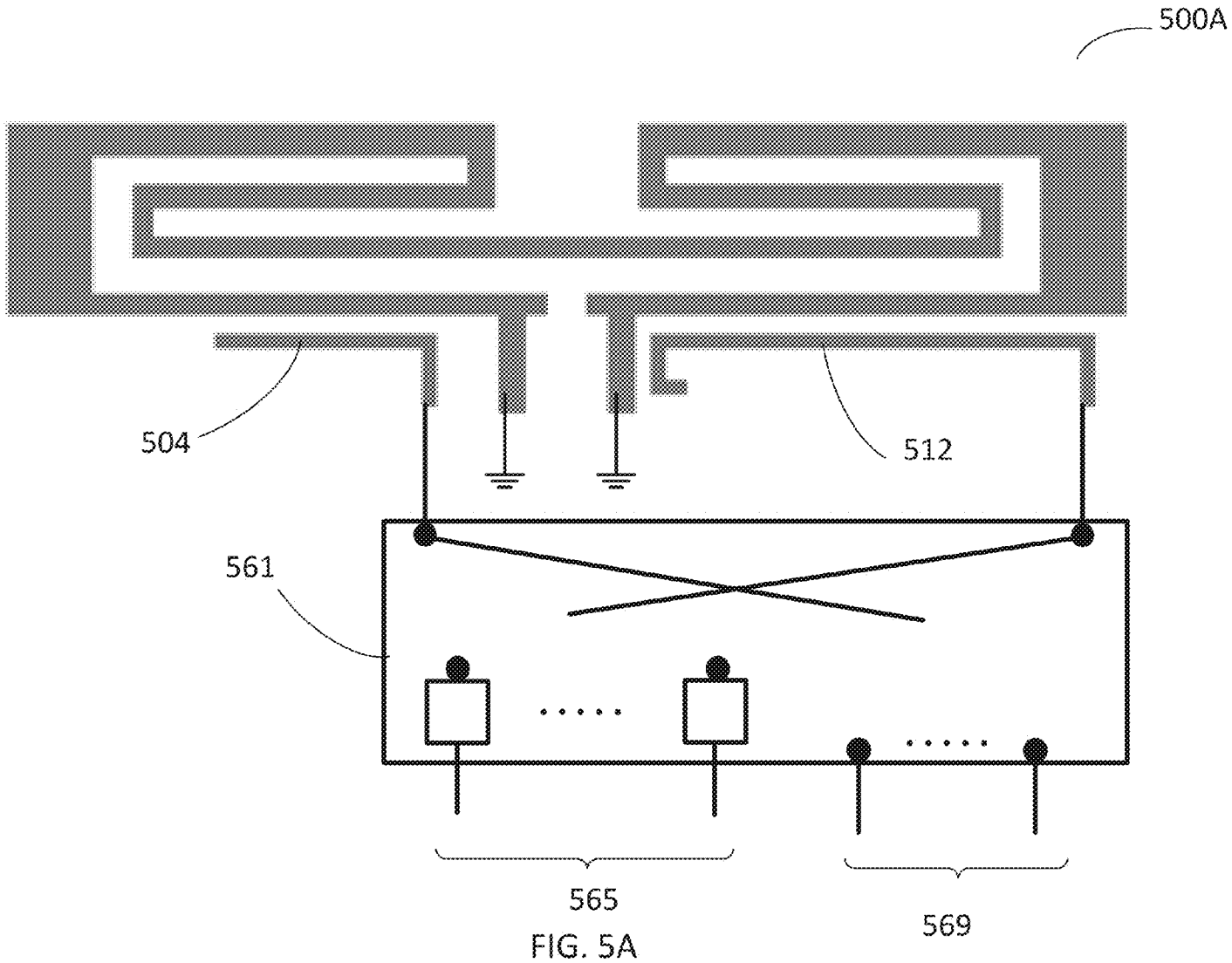
FIG. 5A illustrates another example of a dual-feed antenna according to an embodiment, where a swapping circuit is included.

FIG. 5A illustrates another example of a dual-feed antenna 500A according to an embodiment, where a swapping circuit 561 is included. In this example, the swapping circuit 561 is coupled to the first feed element 504 and the second feed element 512. The swapping circuit 561 is configured to include one or more matching circuits 565 and one or more terminals 569 for RF signal sources. The swapping circuit is controlled by a controller to connect the first feed element 504 and one selected from the group consisting of the one or more matching circuits 565 and the one or more terminals 569 for RF signal sources, and to connect the second feed element 512 and one selected from the group consisting of the one or more matching circuits 565 and the one or more terminals 569 for RF signal sources. The swapping circuit 561 can thus be viewed as a double pole multiple throw (DPMT) switch, where one or more of the multiple throw parts are associated with the one or more matching circuits 565, respectively, and the others of the multiple throw parts are associated with the one or more terminals 569 for RF signal sources.

The swapping circuit can be coupled to the folded loop element as in FIG. 5, or to the feed elements as in FIG. 5A. Alternatively, two or more swapping circuits can be coupled to the folded element and one or more subsets of the feed elements, respectively.

Figure 6:
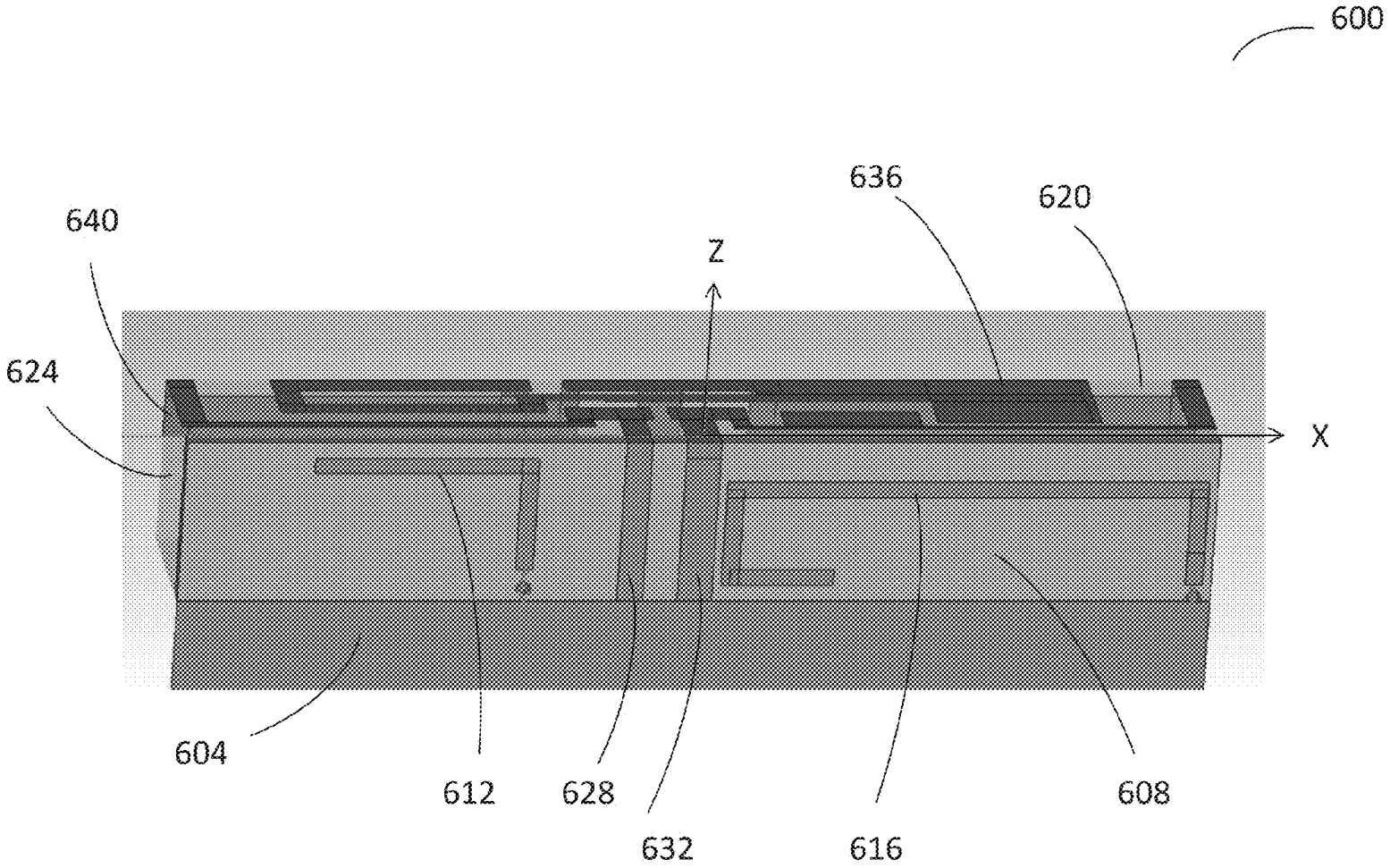
FIG. 6 illustrates an example of a three-dimensional dual-feed antenna according to an embodiment.

Planar multi-feed antennas are described in the examples so far in this document. Two or more feed elements can be included in the antenna, each feed element configured to be capacitively coupled, directly or indirectly, to a common folded loop element. These multi-feed antennas can be configured to be three-dimensional, resulting in further space saving by utilizing the third dimension. FIG. 6 illustrates an example of a three-dimensional dual-feed antenna 600 according to an embodiment. The three-dimensional structure can be supported by air, styrofoam, or other dielectric material such as FR4, ceramic, plastic, etc. In this example, a ground plane 604 is formed on the first X-Z plane 608. A first feed element 612 and a second feed element 616 are also formed on the first X-Z plane 608. The X-Y plane 620 is defined orthogonal to the first X-Z plane 608. The second X-Z plane 624 is defined orthogonal to the X-Y plane 620 and in parallel to the first X-Z plane 608. A folded loop element is formed contiguously on the first X-Z plane 608, the X-Y plane 620 and the second X-Z plane 624. In other words, the three-dimensional folded-loop element can be made by bending a planer folded loop element twice to cover the three surfaces. Each of the feed elements 612 and 616 is capacitively coupled to the folded loop element. The present folded loop element includes a first grounding portion 628 and a second grounding portion 632 on the first X-Z plane 608, both configured to be shorted to the ground plane 604. These grounding portions 628 and 632 are connected, over the first bend, to the segments of the folded loop element on the X-Y plane 620. The segment 636 is an example of a segment of the folded-loop element on the X-Y plane 620. The segments of the folded loop element on the X-Y plane 620 are connected, over the second bent, to the segments of the folded loop element on the second X-Z plane 624. The segment 640 is an example of a segment of the folded loop element on the second X-Z plane 624. As mentioned earlier with reference to FIG. 1, the shape and dimensions of each segment of the folded loop element, the first feed element 612 and the second feed element 608, as well as the width and length of each of the gaps for capacitive coupling, can be adjusted depending on target resonances, bandwidths and other performance metrics.

Implementations and simulations of the three-dimensional dual-feed antenna, an example of which is illustrated in FIG. 6, are carried out. The shape and dimensions of each element and the width and length of each gap for capacitive coupling are configured to provide resonances around the low band of 700-960 MHz region, covering the LTE/WCDMA/CDMA/GSM bands, and the high band of 1700-2700 MHz region, covering the DCS/PCS/UMTS/LTE bands. Simulation results are compared to those of a conventional three-dimensional folded loop antenna having the similar folded loop element. Specifically, the two antennas have the similar structure on the X-Y plane and the second X-Z plane as illustrated in FIG. 6. The feeding and grounding portions on the first X-Z plane are configured differently between the two antennas as illustrated in FIGS. 7 and 8.

Figure 7:
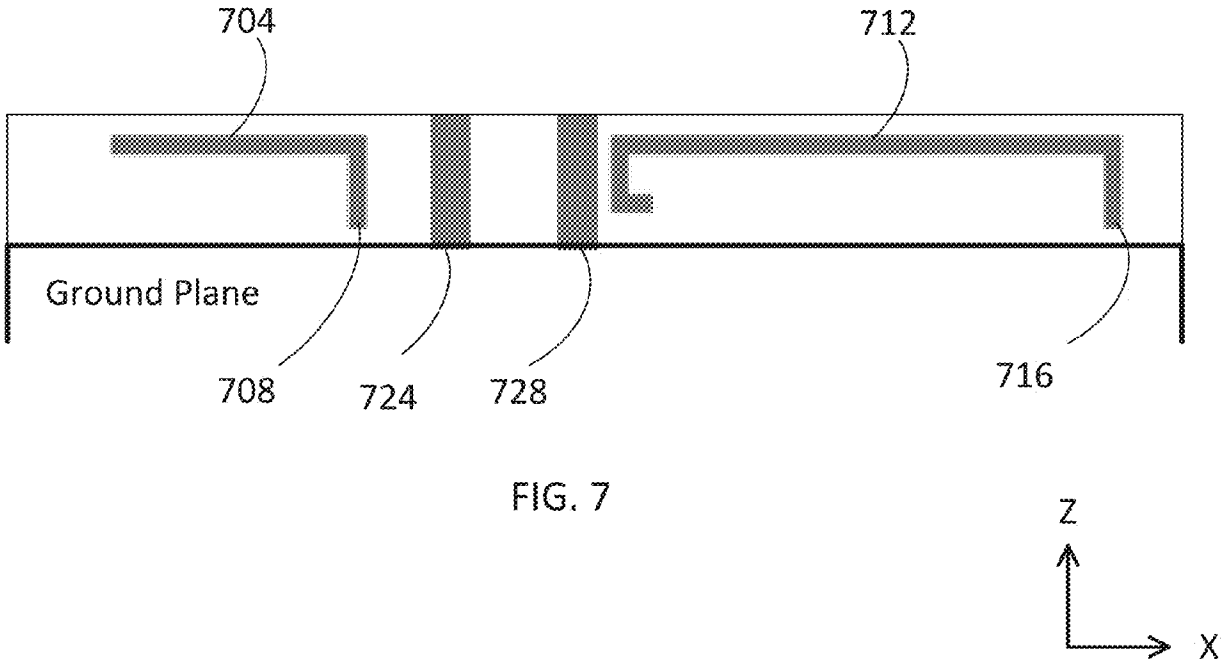
FIG. 7 illustrates the structure of the three-dimensional dual-feed antenna on the first X-Z plane.

FIG. 7 illustrates the structure of the three-dimensional dual-feed antenna on the first X-Z plane. The portion of this antenna on the first X-Z plane has a first feed element 704 having one end portion as a first feed point 708 coupled to an RF signal source, and a second feed element 712 having one end portion as a second feed point 716 coupled to an RF signal source. The first feed element 704 is configured to be shorter than the second feed element 712 in this example; thus, the first feed point 708 is coupled to an RF signal source for the high band, and the second feed point 716 is coupled to an RF signal source for the low band. The folded loop element, which is contiguously formed on the first X-Z plane, the X-Y plane and the second X-Z plane, is shorted to the ground plane at a first end portion 724 and at a second end portion 728.

Figure 8:
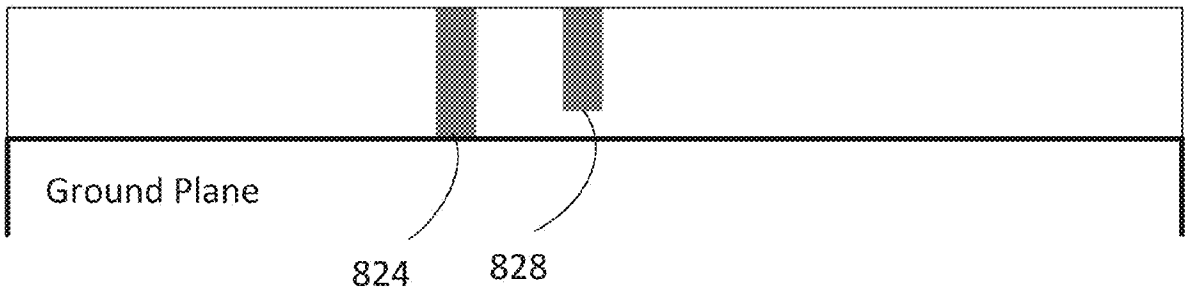
FIG. 8 illustrates the structure of the conventional three-dimensional folded loop antenna on the first X-Z plane.

FIG. 8 illustrates the structure of the conventional three-dimensional folded loop antenna on the first X-Z plane. This antenna has the folded loop element, which is contiguously formed on the first X-Z plane, the X-Y plane and the second X-Z plane, similar to that of the three-dimensional dual-feed antenna as illustrated in FIG. 6. One end portion 824 of the folded loop element is shorted to the ground plane. The other end portion 828 of the folded loop element is a feed point coupled to an RF signal source.

Figure 9:
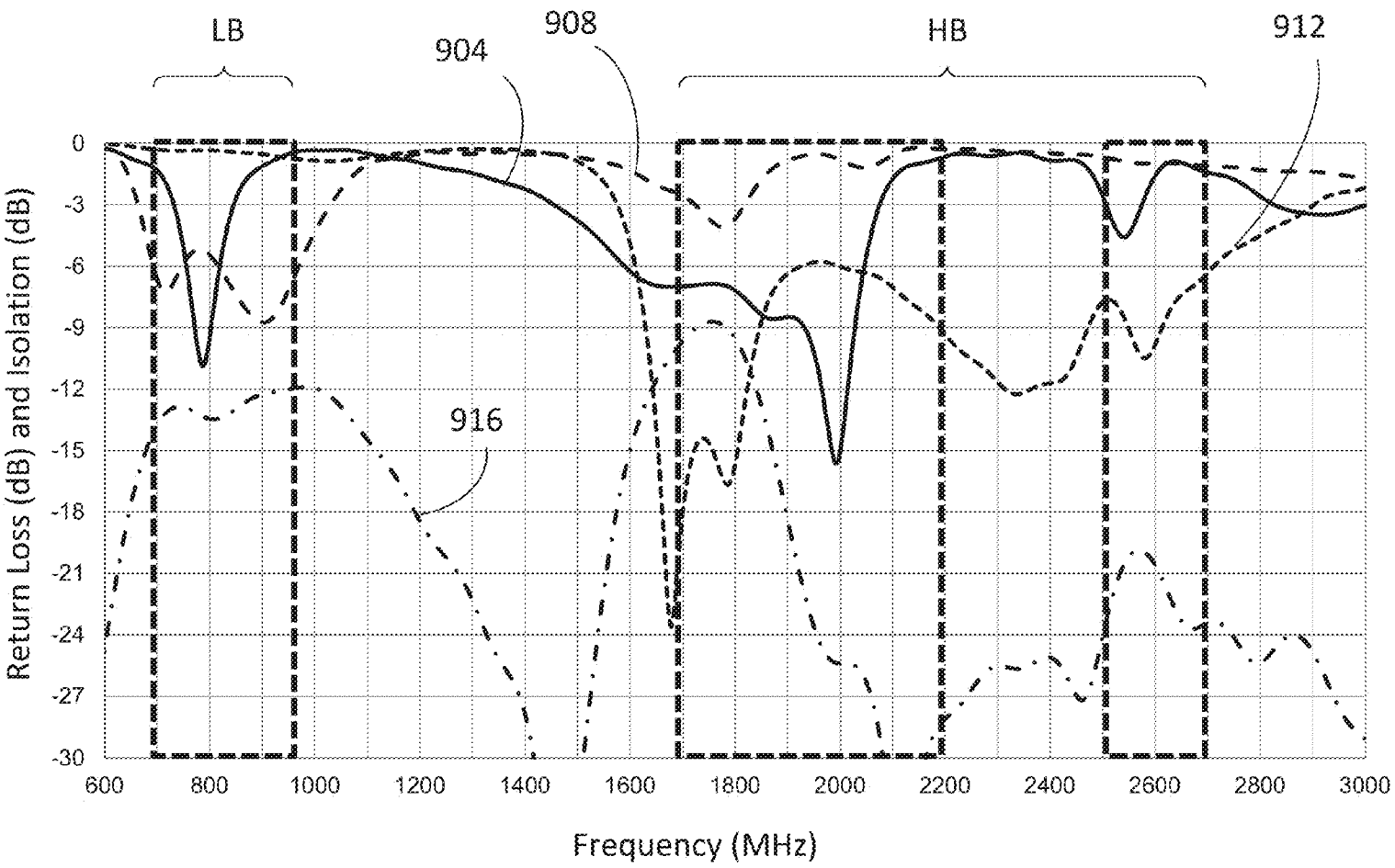
FIG. 9 is a plot showing simulation results of return loss (dB) and isolation (dB) for the three-dimensional dual-feed antenna illustrated in FIG. 7 and the conventional three-dimensional folded loop antenna illustrated in FIG. 8.

FIG. 9 is a plot showing simulation results of return loss (dB) and isolation (dB) for the three-dimensional dual-feed antenna illustrated in FIG. 7 and the conventional three-dimensional folded loop antenna illustrated in FIG. 8. The frequency region of about 700-960 MHz is indicated with low band (LB), and the frequency region of about 1700-2700 MHz is indicated with high band (HB). The return loss for the conventional three-dimensional folded loop antenna is indicated with solid line 904; the return loss for the low band of the three-dimensional dual-feed antenna is indicated with long-dash line 908; the return loss for the high band of the three-dimensional dual-feed antenna is indicated with short-dash line 912; and the isolation between the low band and high band is indicated by dash-dot line 916. These are all simulation results in free space. By comparing the return losses 904 and 912, it can be seen that the present dual-feed antenna can support a wider width of the high band, having the return loss of less than −6 dB, than the conventional folded loop antenna. Furthermore, by comparing the return losses 904 and 908, it can be seen that the present dual-feed antenna can support a wider width of the low band as well, having the return loss of less than −6 dB for about 300 MHz width, than the conventional folded loop antenna.

Figure 10:
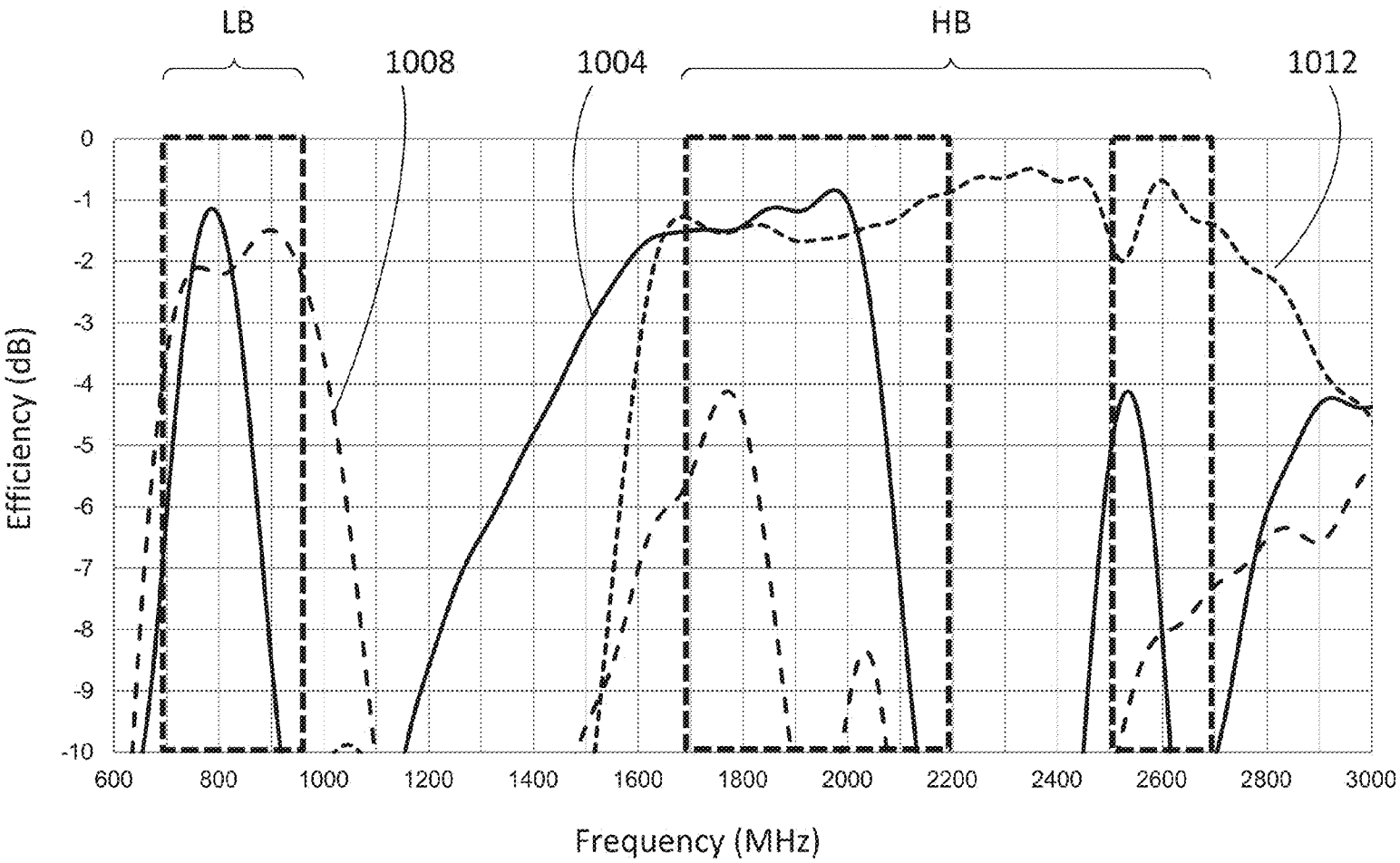
FIG. 10 is a plot showing simulation results of efficiency (dB) for the three-dimensional dual-feed antenna illustrated in FIG. 7 and the conventional three-dimensional folded loop antenna illustrated in FIG. 8.

FIG. 10 is a plot showing simulation results of efficiency (dB) for the three-dimensional dual-feed antenna illustrated in FIG. 7 and the conventional three-dimensional folded loop antenna illustrated in FIG. 8. The frequency region of about 700-960 MHz is indicated with low band (LB), and the frequency region of about 1700-2700 MHz is indicated with high band (HB). The efficiency of the conventional three-dimensional folded loop antenna is indicated with solid line 1004; the efficiency for the low band of the three-dimensional dual-feed antenna is indicated with long-dash line 1008; and the efficiency for the high band of the three-dimensional dual-feed antenna is indicated with short-dash line 1012. These are all simulation results in free space. By comparing the efficiencies 1004 and 1012, it can be seen that the present dual-feed antenna has a higher efficiency than the conventional folded loop antenna in the high band, except for the region around the PCS band. Furthermore, by comparing the efficiencies 1004 and 1008, it can be seen that the present dual-feed antenna has a higher efficiency than the conventional folded loop antenna in the low band.

While this document contains many specifics, these should not be construed as limitations on the scope of an invention or of what may be claimed, but rather as descriptions of features specific to particular embodiments of the invention. Certain features that are described in this document in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be exercised from the combination, and the claimed combination may be directed to a subcombination or a variation of a subcombination.

What is claimed is:

1. A multi-feed antenna comprising:

a plurality of feed elements associated with a plurality of frequency regions, respectively; and a folded loop element for radiating energy;

wherein each of the plurality of feed elements is capacitively coupled to the folded loop element; and wherein the folded loop element includes one or more portions connected to ground.

2. The multi-feed antenna of claim 1, wherein each of the plurality of feed elements is capacitively coupled, directly or indirectly through an intermediary element, to the folded loop element.

3. The multi-feed antenna of claim 1, wherein at least one of the one or more portions connected to ground includes two or more branches and a switch provided at the branching point, wherein a matching circuit is coupled to at least one of the two or more branches, which is shorted to ground, while the other branches are directly shorted to ground, wherein the switch is controlled to select a branch for direct grounding or impedance loading for the folded loop element, the impedance loading afforded by the matching circuit coupled to the branch.

4. The multi-feed antenna of claim 1, wherein one or more of the plurality of feed elements are coupled to one or more matching circuits, respectively, which provide impedance loading for the respective feed elements.

5. The multi-feed antenna of claim 1, wherein a swapping circuit is coupled to the folded loop element or to the plurality of feed elements, wherein the swapping circuit includes one or more matching circuits for impedance loading according to environments or conditions.

6. The multi-feed antenna of claim 5, wherein the folded loop element includes one or more portions for grounding; and the swapping circuit coupled to the folded loop element further includes one or more ground terminals, and the one or more matching circuits are shorted to ground, wherein the swapping circuit is controlled to connect each of the one or more portions for grounding and one selected from a group consisting of the one or more matching circuits and the one or more ground terminals.

7. The multi-feed antenna of claim 5, wherein the swapping circuit coupled to the plurality of feed elements further includes one or more terminals for one or more signal sources, and the one or more matching circuits are coupled to one or more signal sources, wherein the swapping circuit is controlled to connect each of the plurality of feed elements and one selected from a group consisting of the one or more matching circuits and the one or more terminals for one or more signal sources.

8. The multi-feed antenna of claim 5, wherein two or more swapping circuits are coupled to the folded element and one or more subsets of the feed elements, respectively.

* * * * *